US007168663B2

(12) United States Patent
Schnedl

(10) Patent No.: US 7,168,663 B2
(45) Date of Patent: Jan. 30, 2007

(54) POINT MACHINE FOR MOVABLE FROGS

(75) Inventor: Karl Schnedl, Knittelfeld (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 0 days.

(21) Appl. No.: 10/523,564

(22) PCT Filed: Jun. 16, 2003

(86) PCT No.: PCT/AT03/00169

§ 371 (c)(1),
(2), (4) Date: Feb. 3, 2005

(87) PCT Pub. No.: WO2004/014709

PCT Pub. Date: Feb. 19, 2004

(65) Prior Publication Data

US 2005/0269459 A1 Dec. 8, 2005

(30) Foreign Application Priority Data

Aug. 13, 2002 (AT) ..... A 1228/2002

(51) Int. Cl.
*E01B 7/00* (2006.01)

(52) U.S. Cl. ..... 246/450; 246/449

(58) Field of Classification Search ..... 246/448, 246/450, 452, 415 R, 405, 257, 258, 262, 246/430; 188/67, 69, 68, 82.2
See application file for complete search history.

(56) References Cited

U.S. PATENT DOCUMENTS

| | | | | |
|---|---|---|---|---|
| 1,253,439 | A * | 1/1918 | Stiles | 246/158 |
| 1,446,743 | A * | 2/1923 | Fisher | 246/158 |
| 1,744,604 | A * | 1/1930 | Arledge | 246/448 |
| 3,521,053 | A * | 7/1970 | Munch et al. | 246/468 |
| 3,723,728 | A | 3/1973 | von Hayn | |
| 5,292,091 | A * | 3/1994 | Callegari et al. | 246/258 |
| 6,056,244 | A * | 5/2000 | Durchschlag et al. | 246/257 |
| 6,511,024 | B1 * | 1/2003 | Bonfigli | 246/415 R |
| 6,789,770 | B2 * | 9/2004 | Schnedl | 246/448 |

FOREIGN PATENT DOCUMENTS

| | | | |
|---|---|---|---|
| DE | 4305228 | A1 | 8/1994 |
| EP | 320636 | A2 * | 6/1989 |
| EP | 467865 | A1 * | 1/1992 |
| WO | WO 02/055361 | A1 | 7/2002 |

* cited by examiner

*Primary Examiner*—Mark T. Le
(74) *Attorney, Agent, or Firm*—Chapman and Cutler LLP

(57) ABSTRACT

In a switch actuator for movable frogs (1), comprising at least one cylinder piston unit (5) having a defined preset piston stroke, the cylinder piston unit (5) is connected with bearings (6) capable of being displaced in the axial direction of the piston stroke, which bearings are connected with a stationary substructure for the adjustment of a defined center position of the piston stroke and the driver for the movable frog (1). The driver for the movable frog (1) is coupled with the cylinder piston unit (5) with first stops (9) displaceable in the axial direction being interposed.

20 Claims, 4 Drawing Sheets

POINT MACHINE FOR MOVABLE FROGS

The invention relates to a switch actuator for movable frogs, comprising at least one cylinder piston unit having a defined preset piston stroke.

With switch actuators for movable frogs it is necessary to adapt the actuating device, and switch actuator, to the exact displacement path of the movable frog. The two positions, or end positions, in the displacement of a frog must each ensure precise abutment on the wing rail, and displacement must naturally occur in a manner so as to avoid overstressing of the switch actuator in any of these abutment positions. Due to manufacturing tolerances as well as frog and wing rail wear, it must be feasible to adjust the stroke of the actuating system to the exact displacement path actually required of the frog between the right-hand and left-hand abutment positions. Such a correct adjustment of the stroke must also be feasible on site in the laid switch.

Especially when using trough sleepers, and with an increasing extent of prefabrication of hydraulic switch actuators, cylinder piston units are already at the factory being provided with preset cylinder strokes, thus calling for a precise adjustment in the trough sleeper as well as the setting of the actually required displacement path subsequently.

The invention aims to provide a switch actuator of the initially defined kind, which enables the use of prefabricated cylinder piston units having defined preset piston strokes, wherein the precise adjustment of the actually required displacement path will still be safeguarded subsequently upon installation into the laid switch. To solve this object, the configuration of the switch actuator of the initially defined kind according to the invention essentially consists in that the cylinder piston unit is connected with bearings capable of being displaced in the axial direction of the piston stroke, which bearings are connected with a stationary substructure for the adjustment of a defined center position of the piston stroke and the driver for the movable frog, and that the driver for the movable frog is coupled with the cylinder piston unit with stops displaceable in the axial direction being interposed. Due to the fact that the cylinder piston unit is connected with bearings capable of being displaced in the direction of the piston, is has become feasible to arrange in a sleeper, particularly in a trough sleeper, a cylinder piston unit designed with a defined piston stroke at the factory, whose stroke preset at the factory must in any event be larger than the actual stroke of the movable switch part or frog, in a manner so as to enable a precise positioning in the sense of a defined center position of the displacement path of the cylinder piston unit. To this end, the displaceable bearings must be appropriately displaced such that the cylinder piston unit is altogether oriented in a manner that the center position of the movable frog point, or movable frog, corresponds with the center position of the preset stroke of the cylinder piston unit. Departing from such a basic center position adjustment, it has now become feasible, by the driver for the movable frog being coupled with the cylinder piston unit with stops displaceable in the axial direction being interposed, to shift these displaceable stops to such an extent that the driver will each be coupled with the cylinder piston unit, and hence define the displacement movement of the frog, only after an accordingly adjusted idle stroke. The extent by which the preset piston stroke of the cylinder piston unit is larger than the displacement path of the movable frog actually required in the installed position is compensated by the adjustment of the respective idle stroke such that, in the main, a displacement of the movable frog between the two abutment positions is feasible by the exactly required extent and at an accordingly extremely small tolerance of about 0.1 mm.

In order to ensure such highly precise setting without entailing the risk of any premature wear of the actuating members, the driver or the cylinder piston units, the configuration is advantageously devised such that the driver comprises a sliding block and enables a relative movement of the frog along two mutually crossing axes different from the axis of the displacement stroke. Such a quasi-cardanic suspension allows for the appropriate absorption of relative movements of switch parts under the rolling load without overstressing the high-precision-oriented drivers and stops as well as the coupling parts to the cylinder piston unit.

The exact setting of the stroke, or exact setting of the idle stroke, is feasible in a simple manner in that the driver, in the direction of the displacement stroke, is traversed by a spindle having different thread directions on the two sides of the driver, and cooperates with nuts guided in a rotationally fast manner to adjust the idle strokes. Since, as mentioned in the beginning, the cylinder piston unit initially is precisely adjusted to its center position, such a spindle at the same time enables the displacement stroke to be altered on both sides of the center, and hence altogether adjusted to the exactly required displacement path of the frog, with identical idle strokes being formed on either side of the center position.

The movable frog during its pivotal movement, to be precise, is guided and moved over a circular arc, especially near the frog point, so that, due to the linear orientation of the displacement stroke, a number of additional forces and, in particular, pivot forces have to be taken up without entailing any risk of overstressing. The appropriate resilience in the longitudinal direction of the rails will be safeguarded in a simple manner by conventional means such as, for instance, oblong holes or the like. However, in order to ensure a relative pivotal movement of the frog and, in particular, frog point relative to the driver and, in particular, sliding block of the driver, and avoid the absorption of vertical movements during the passage of a switch under rolling load, or at a shift of the frog point in cooperation with a rolling device, the configuration is advantageously devised such that the driver is arranged to be pivotable about the axis of the cylinder piston unit, and that the sliding block of the driver carries or comprises a tappet or cylinder portion arranged to be pivotable about an axis extending substantially normal to the direction of the displacement stroke.

As in correspondence with a further development, an adjustment device particularly simple in terms of construction and readily actuatable even from outside, for adjusting the center position of the cylinder piston unit in a trough sleeper is devised such that the bearings capable of being displaced in the axial direction of the piston stroke are each designed as a fork head whose fork is supported in a rotationally fast manner while displaceable in the axial direction and connected with the hydraulic cylinder piston unit via a bearing journal, and that to the fork head is connected a fork head screw that traverses a stop and carries an adjusting nut, turning of which causes an axial displacement of the fork head. Relative displacement relative to the outer side of the trough sleeper may be obtained via the fork head screw by an appropriate turn of the adjusting screw, the respective adjustment being obtained by the actuation of adjusting nuts on both sides of the trough sleeper. In order to enable the particularly simple insertion of a prefabricated and preset cylinder piston unit into such a trough sleeper while, at the same time, safeguarding that the respective anti-rotation locks will enter into effect after insertion, which is necessary for an axial displacement and hence the exact positioning of the center stroke, the configuration is advantageously devised such that the stop is designed as an upwardly open slot of a wall of a trough sleeper extending transversely to the longitudinal direction of the sleeper, or of a stationary part of a switch.

In the main, there is thus provided an adjustment locking cylinder fulfilling the functions of displacing, locking, and monitoring the locking of, a movable switch part and having a configuration set at a defined stroke at the factory, said stroke set at the factory being in any event larger than the stroke of the movable switch part. The actual adaptation of the stroke to a particular rail switch is performed by adjusting the idle stroke between the driver on the switch locking cylinder and the movable switch part, the stroke of the switch part being variable, and hence continuously adaptable, by regulating the idle stroke at a constant cylinder stroke. On the left-handed and right-handed thread, respectively, in the center region of the symmetrical spindle rod of the spindle drive, are each provided two driver nuts guided positively, yet slidingly on the driver housing, while the spindle rod itself passes through a sliding block. In order to ensure an accordingly attenuated impact after having passed the idle stroke, the nuts may each cooperate with the sliding block or sliding block carrier of the driver part via an interposed cup spring, wherein the sliding block itself cooperates with the structural components directly connected with the movable frog. The sliding block, which itself forms part of the driver, thus takes up those structural components which are to ensure the transmission of the displacement path onto the frog, these parts immersing in the sliding block, in turn, pivotally engaging in the sliding block to prevent respective overstressing.

The entire locking device is mounted to frame parts of a trough sleeper, whereby the fork heads, which are each provided with a spindle, cooperate with mating adjusting nuts in order to enable the adjustment of the center position. The steps required for precision-setting, thus, consist in initially adjusting to the maximum stroke the idle stroke on one side, displacing the frog into an end position, measuring the distance between frog and wing rail, and displacing the frog into the other end position while measuring the distance anew, whereupon center adjustment is carried out until the same distance between frog and wing rail is reached on both sides. Departing from this center adjustment the idle stroke is then reduced by the distance measure, which finally results in the exact adjustment.

In the following, the invention will be explained in more detail by way of an exemplary embodiment schematically illustrated in the drawing. Therein, FIG. 1 shows a vertical section through a switch including a switch actuator;

Figure 1:
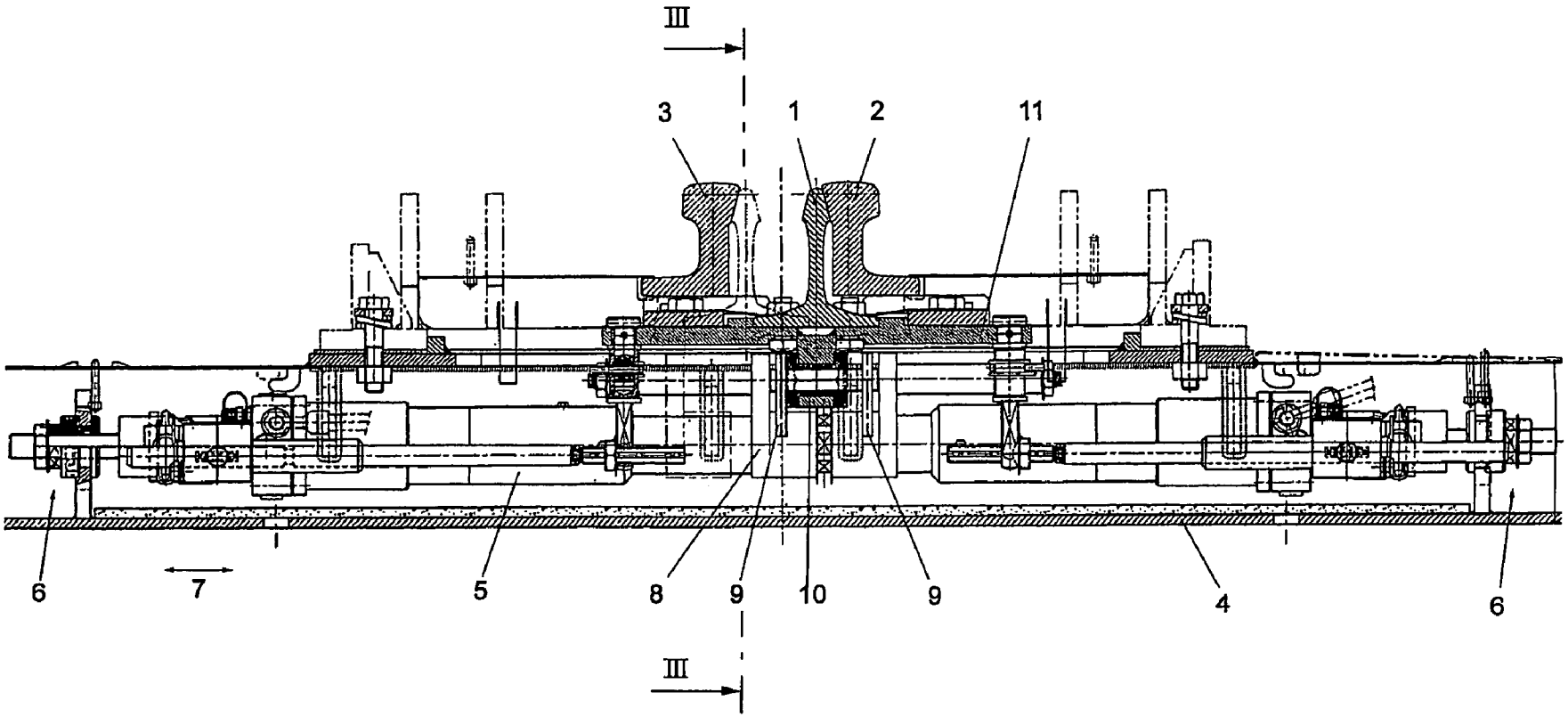

In FIG. 1, a movable frog denoted by 1 is displaceable into abutment on the wing rail 2 or 3, respectively. All of the components of the switching, locking and checking devices are arranged in a trough sleeper 4 below the track plane. The switching device 5 in this case is comprised of a cylinder piston unit and articulately connected to the stationary trough sleeper via bearings 6. As will be explained below, the bearings 6 are devised such that an adjustment of the switching device 5 is feasible in the longitudinal direction of the sleeper in the sense of double arrow 7 so as to enable the adjustment of the center position of the cylinder piston unit. The switching device 5 is coupled to a driver part 8 which transmits the switching movement to the movable frog 1. Driving is effected via first displaceable stops 9 cooperating with a sliding block 10, which in turn is connected with the base plate 11 of the movable frog 1. The precise adjustment of the effective stroke of the movable frog 1 is feasible by the adjustment of an idle stroke between these first stops 9 and the sliding block 10.

Figure 2:
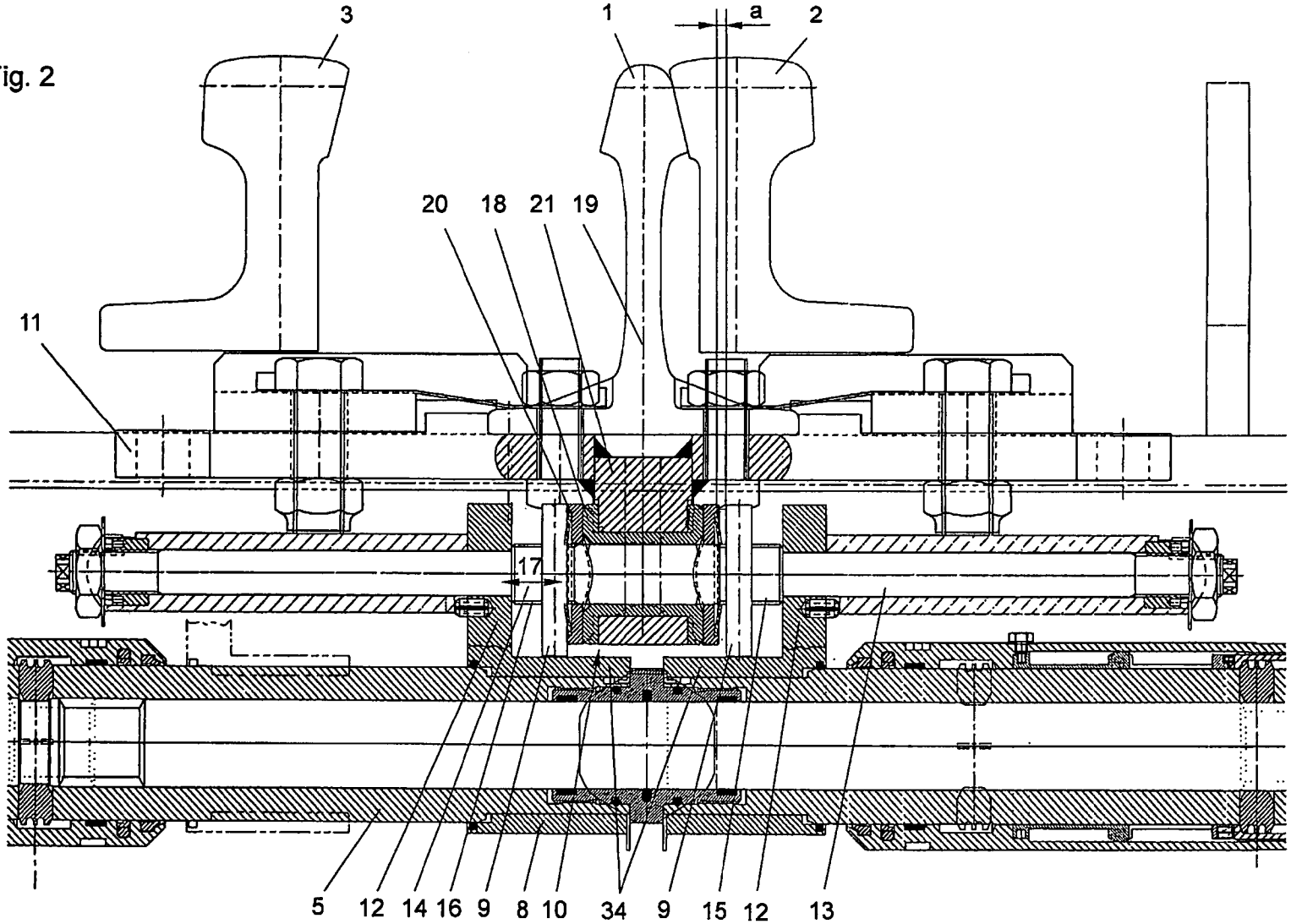
FIG. 2 is a detailed view of the switch actuator and driver for the movable frog.

FIG. 2 depicts the individual coupling and driver parts on an enlarged scale. It is apparent that the driver 8, which is pivotally supported on the cylinder piston unit, is comprised of two sleeves 34 surrounding the cylinder piston unit 5 and having projections 12 through which a spindle 13 passes, the position of the spindle 13 relative to the projections 12 of the driver 8 being fixed by stop shoulders formed by the larger diameter-region 14 of the spindle 13. The larger-diameter-region 14 of the spindle 13 further comprises two threaded portions 15 and 16 having mutually opposed thread directions. A turn of the spindle causes the first stop parts 9 mounted on the threaded regions 15 and 16 in a rotationally fast manner to be moved away from each other, or towards each other, in the manner of a driver nut in the sense of double arrow 17. The driver part further comprises a sliding block 10 through which the spindle 13 passes and on which it is mounted so as to be slidingly movable between the first stops 9. By displacing the first stops 9 in the sense of double arrow 17, it is feasible to adjust the idle stroke a between the first stops 9 and the sliding block 10 in order to reduce the switching stroke of the cylinder piston unit 5 to the respectively required displacement stroke of the movable frog 1.

The sliding block 10 further comprises an inner part 18 including a cylinder portion with a cylinder axis 19 so as to allow for a pivotal movement of the cylinder part 18 about the rotational axis 19 relative to the outer part 20 of the sliding block 10 and hence relative to the driver 8. The cylinder part 18 engages in a driver stirrup 21, which in turn is welded with the base plate 11 of the movable frog 1, so that, in the main, a compensation movement is rendered feasible during the pivotal movement of the frog 1 relative to the switching device 5, which is necessary for the switching movement of the frog 1.

Figure 3:
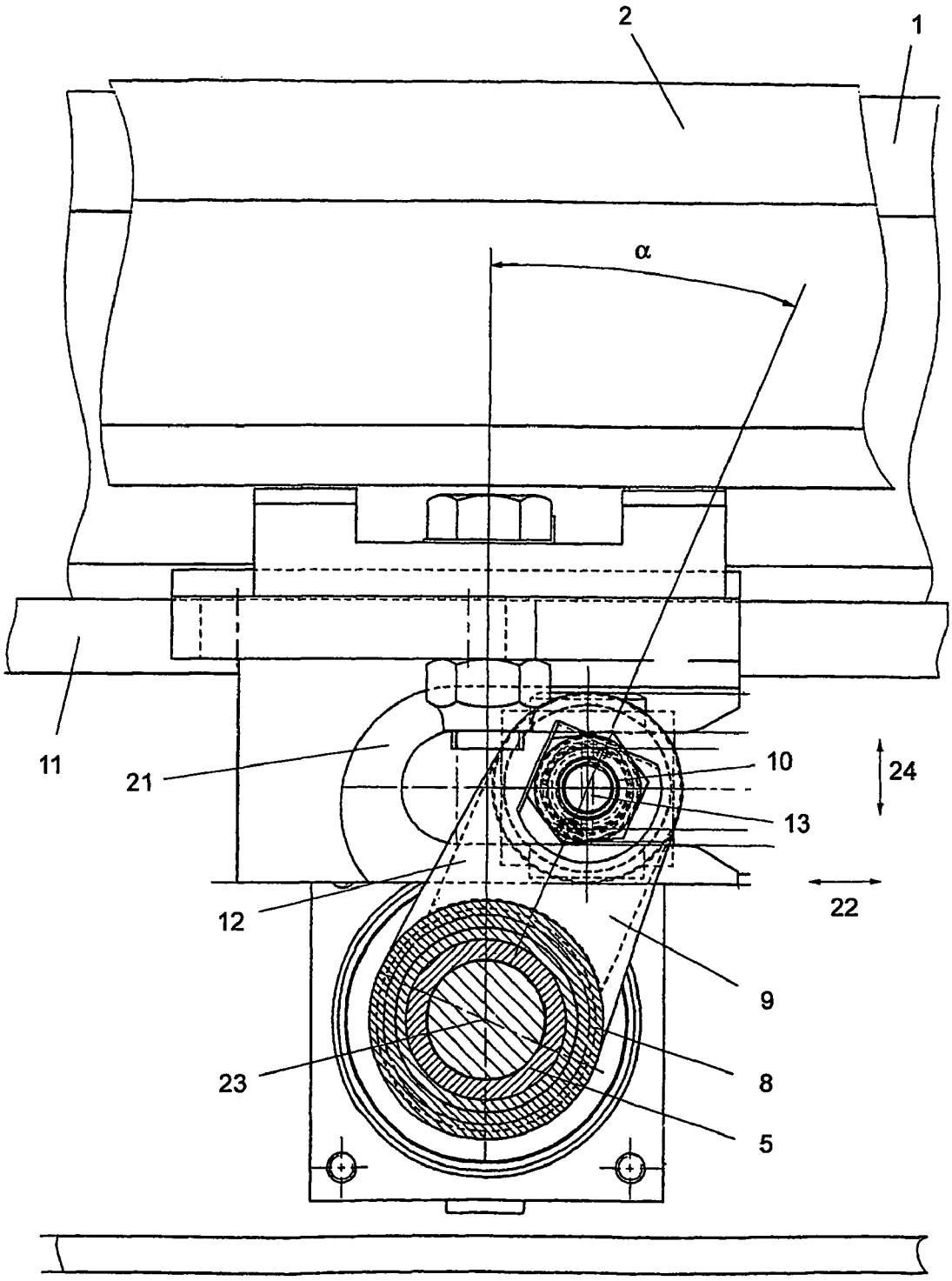
FIG. 3 is a section along line III—III of FIG. 1.

From the side view according to FIG. 3, the stirrup-shaped form of the driver part 21 is apparent, it being recognizable that the sliding block 10 is slidingly movable in the stirrup-shaped driver part 21 along double arrow 22 such that longitudinal displacements of the movable frog 1 possibly caused, for instance, by thermal expansions will not be transmitted to the switching mechanism. Furthermore, it is apparent that the first stops 9, i.e. the driver nuts, are supported on the sleeves 34 of the drivers in a rotationally fast manner. This is to obtain an anti-rotation lock of the first stops 9 relative to the rotation of the spindle and to ensure the axial displacement of the first stops 9. The positioning of the driver 8 relative to the axis 23 at a central angle $\alpha$ occurs as a function of the upward or downward movement in the sense of double arrow 24 and the displacement in the longitudinal direction of the rail in the sense of double arrow 22, of the movable frog such that forces resulting from these movements will be prevented from being introduced into the cylinder piston unit.

Figure 4:
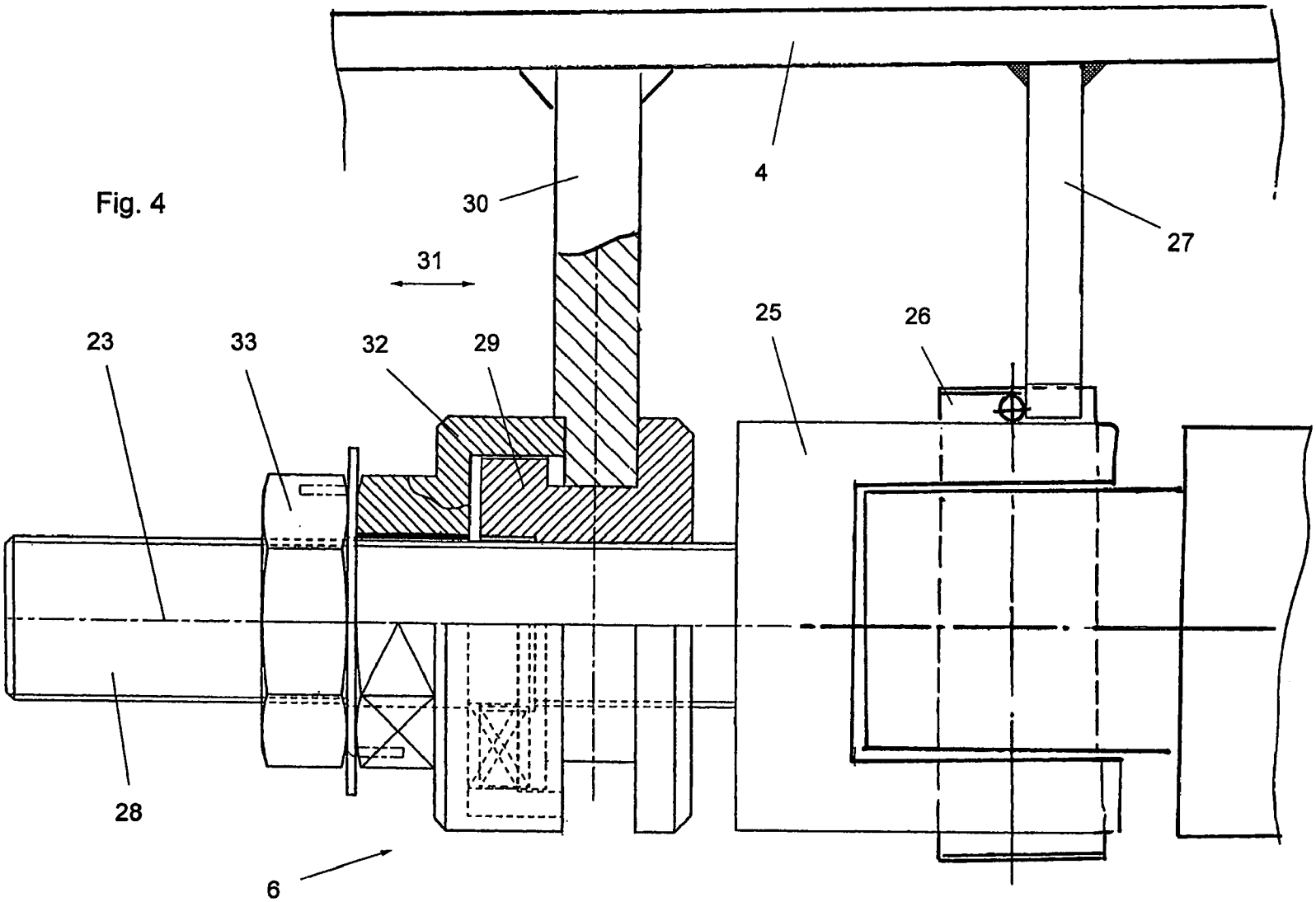
FIG. 4 is a detailed view of the displaceable bearings used to mount the cylinder piston unit in the trough sleeper.

FIG. 4 elucidates the mounting of the cylinder piston unit 5 on the trough sleeper 4. In this case, the bearing 6 is provided with a fork head 25 whose fork is supported in a rotationally fast manner while being displaceable in the direction of the axis 23 of the cylinder piston unit 5, and is connected with the hydraulic cylinder piston unit 5 via a bearing journal 26. Here, the fixation of the rotary position of the fork head 25 is effected in that the fork head 25 is supported on a web 27 departing from the side wall of the trough sleeper. The fork head 25 is connected with a fork head screw 28 carrying an adjusting nut 29. A turn of the adjusting nut 29, whose axial position is fixed by the aid of the second stop 30 rigidly connected with the trough sleeper 4, causes an axial displacement of the fork head 25 in the sense of double arrow 31. The adjusted axial position of the fork head is fixed by the aid of union part 32 and nut 33. This axial displacement of the fork head, and hence the cylinder piston unit, which must, of course, take place in both of the adjustable bearings 6 on both sides of the cylinder piston unit, enables the precise adjustment of the center position of the piston stroke.

The invention claimed is:

1. A switch actuator for movable frogs, comprising at least one cylinder piston unit having a defined preset piston stroke, wherein the cylinder piston unit (5) is connected with bearings (6) capable of being displaced relative to said cylinder piston unit (5) in an axial direction (31) of the piston stroke, said bearings are connected to a stationary substructure by an adjusting means for adjusting a defined center position of the piston stroke and a driver for a movable frog (1), and the driver for the movable frog (1) is coupled with the cylinder piston unit with first stops (9) being interposed between the cylinder piston unit (5) and the movable frog (1), said first stops being displaceable in the axial direction of the piston stroke.

2. A switch actuator according to claim 1, wherein the driver comprises a sliding block (10) and enables a relative movement of the frog (1) along two mutually crossing directions different from a direction of a displacement stroke.

3. A switch actuator according to claim 1, wherein the driver, in a direction of a displacement stroke, is traversed by a spindle (13) having different thread directions on two sides of the driver, and cooperates with said first stops (9) guided in a rotationally fast manner to adjust idle strokes.

4. A switch actuator according to claim 1, wherein the driver is arranged to be pivotable about an axis of the cylinder piston unit (5), and further comprising a sliding block (10) of the driver comprising a tappet or cylinder portion (18) arranged to be pivotable about an axis (19) extending substantially normal to a direction of a displacement stroke.

5. A switch actuator according to claim 1, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

6. A switch actuator according to claim 5, wherein the second stop (30) is designed as an open slot of a wall of a trough sleeper (4) extending transversely to a longitudinal direction of the sleeper, or of a stationary switch part.

7. A switch actuator according to claim 2, wherein the driver, in the direction of the displacement stroke, is traversed by a spindle (13) having different thread directions on two sides of the driver, and cooperates with said first stops (9) guided in a rotationally fast manner to adjust idle strokes.

8. A switch actuator according to claim 2, wherein the driver is arranged to be pivotable about an axis of the cylinder piston unit (5), and the sliding block (10) of the driver comprises a tappet or cylinder portion (18) arranged to be pivotable about an axis (19) extending substantially normal to the direction of the displacement stroke.

9. A switch actuator according to claim 3, wherein the driver is arranged to be pivotable about an axis of the cylinder piston unit (5), and further comprising a sliding block (10) of the driver comprising a tappet or cylinder portion (18) arranged to be pivotable about an axis (19) extending substantially normal to the direction of the displacement stroke.

10. A switch actuator according to claim 7, wherein the driver is arranged to be pivotable about an axis of the cylinder piston unit (5), and the sliding block (10) of the driver comprises a tappet or cylinder portion (18) arranged to be pivotable about an axis (19) extending substantially normal to the direction of the displacement stroke.

11. A switch actuator according to claim 2, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

12. A switch actuator according to claim 3, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

13. A switch actuator according to claim 4, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

14. A switch actuator according to claim 7, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

15. A switch actuator according to claim 8, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

16. A switch actuator according to claim 9, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

17. A switch actuator according to claim 10, wherein the bearings (6) capable of being displaced in the axial direction (31) of the piston stroke are each designed as a fork head (25) whose fork is supported in a rotationally fast manner while displaceable in the axial direction (31) and connected with the hydraulic cylinder piston unit (5) via a bearing journal (26), and the fork head (25) is connected to a fork head screw (28) that traverses a second stop (30) and comprises an adjusting nut (29), turning of which causes an axial displacement of the fork head (25).

18. A switch actuator according to claim 11, wherein the second stop (30) is designed as an open slot of a wall of a trough sleeper (4) extending transversely to a longitudinal direction of the sleeper, or of a stationary switch part.

19. A switch actuator according to claim 12, wherein the second stop (30) is designed as an open slot of a wall of a trough sleeper (4) extending transversely to a longitudinal direction of the sleeper, or of a stationary switch part.

20. A switch actuator according to claim 13, wherein the second stop (30) is designed as an open slot of a wall of a trough sleeper (4) extending transversely to a longitudinal direction of the sleeper, or of a stationary switch part.

* * * * *